United States Patent [19]

Bonner

[11] Patent Number: 4,494,592

[45] Date of Patent: Jan. 22, 1985

[54] MAILING BAG WITH ADDRESS MOUNTING POCKET AND TAMPER PROOF TIE SECURING MEANS ATTACHABLE TO CARD AND SLIDE ZIPPER PREVENTING SURREPTITIOUS ACCESS THEREINTO

[75] Inventor: Cletus D. Bonner, Beaver, Pa.

[73] Assignee: Strayer Coin Bag Co. Inc., New Brighton, Pa.

[21] Appl. No.: 476,356

[22] Filed: May 3, 1983

[51] Int. Cl.[3] ..... A45C 13/00

[52] U.S. Cl. ..... 383/5; 383/40; 383/97

[58] Field of Search ..... 150/13, 15, 23; 383/9, 383/97, 40, 5; D3/59, 71; 40/10 R, 10 D, 159, 359

[56] References Cited

U.S. PATENT DOCUMENTS

| | | | |
|---|---|---|---|
| 498,180 | 5/1893 | Manahan | 383/9 |
| 1,680,652 | 8/1928 | Walinsky | 383/97 |
| 1,771,429 | 7/1930 | Wisbith | 383/97 |
| 2,363,926 | 11/1944 | Arens | 383/9 |
| 2,707,010 | 4/1955 | Armistead | 383/40 |
| 2,947,464 | 8/1960 | Newton | 383/9 |
| 3,078,897 | 2/1963 | Rifkin | 383/97 |
| 3,646,723 | 3/1972 | Meroney | 383/9 |
| 3,818,963 | 6/1974 | Whitman | 150/13 |
| 4,108,227 | 8/1978 | Bonner | 150/15 |
| 4,112,990 | 9/1978 | Anderson | 383/97 |
| 4,153,090 | 5/1979 | Rifkin | 383/40 |
| 4,201,299 | 5/1980 | Bumgarner et al. | 383/9 |

*Primary Examiner*—Joseph Man-Fu Moy
*Assistant Examiner*—David Fidei
*Attorney, Agent, or Firm*—W. Britton Moore

[57] ABSTRACT

A panelled mailing bag with zippered opening and a spaced two-part address card mounting pocket on a panel thereof with a card so received therein that the mid portion is exposed to receive postage and enable ready cancellation thereof. The card is apertured for securement by seal means to the zipper slide and eyeletted patches on the bag panels whereby the slide is maintained in closed locked position and unauthorized access to the bag is prevented without leaving overt evidence.

4 Claims, 4 Drawing Figures

MAILING BAG WITH ADDRESS MOUNTING POCKET AND TAMPER PROOF TIE SECURING MEANS ATTACHABLE TO CARD AND SLIDE ZIPPER PREVENTING SURREPTITIOUS ACCESS THEREINTO

BRIEF SUMMARY OF THE INVENTION

This invention relates to a zippered opening mailing bag with a spaced two-part mounting pocket on a panel thereof for receiving an apertured address card therein with the mid portion exposed for receiving postage and enabling ready cancellation thereof, and having sealing tie means securable to eyeletted patches on the bag panels and to the slide fastener for preventing loss of the card and retaining the slide in locked position so as to prevent unauthorized back sliding of the slide and access to the contents without severing the tie and leaving tell-tale evidence.

CROSS REFERENCE TO PRIOR ART

While its has been customary to utilize zippered mailing or transit bags for making deposits in financial institutions, and for other purposes, with address or mailing cards variously attached thereto, such as disclosed in Rifkin U.S. Pat. Nos. 3,078,897 and 4,153,090; Whitman 3,818,963; and Bonner 4,108,227, the cards thereof either are unsecured in their mounting pockets and subject to loss, attachable by tie means extending through the panel walls, or by tie means extending over the bag mouth but unsecured to the slide, or by utilizing tie means attachable directly to a particularly designed small hole zipper slider. None of these prior art devices insure complete sealing of the zipper and prevent unauthorized access thereinto without severing the tie, and retain the shipping card in place.

SUMMARY OF THE INVENTION

The principle object of the present invention is to provide a zippered opening panelled mailing bag with a two-part address card mounting pocket on a panel thereof for receiving an apertured card therein for securement by seal means to eyeletted panel patches and to an apertured slide fastener whereby the latter is retained in closed locked position and unauthorized access to the bag prevented without severing the seal means and leaving tell-tale evidence.

Another object is the provision of a panelled mailing bag with an apertured address card sleevable in a pocket and attachable by plastic sealing means connected to eyeletted panel patches and an aperture in the slider finger grip of the zipper slider whereby the grip and zipper is retained in closed locked position and surreptitious back sliding of the zipper prevented and/or unauthorized access thereinto precluded without severing the seal.

These and other objects and advantages will be apparent as the specification is considered with the accompanying drawings, wherein.

DETAILED DESCRIPTION

Figure 1:
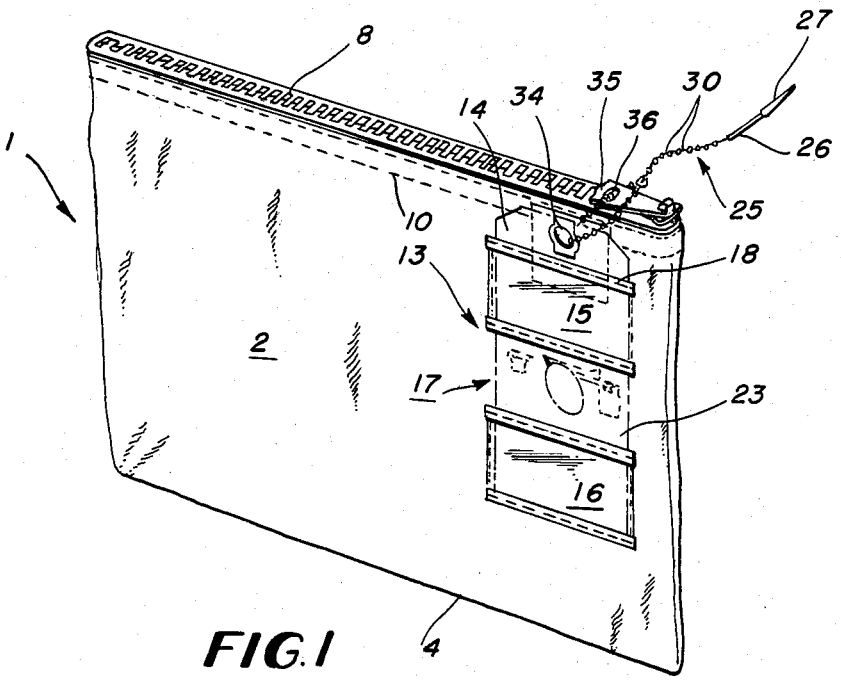
FIG. 1 is a perspective view of a zippered mailing bag embodying this invention.
Figure 2:
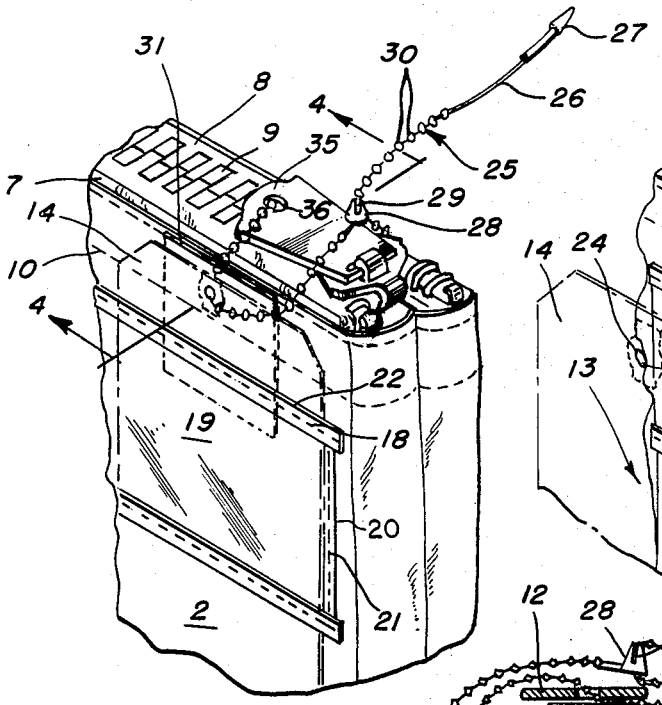
FIG. 2 is a perspective view of a portion of the bag of FIG. 1, showing the plastic seal attached to the eyeletted panel patches, the protruding apertured upper end of the address card, and to the apertured end of the slider finger grip and holding the latter in closed locked position.
Figure 3:
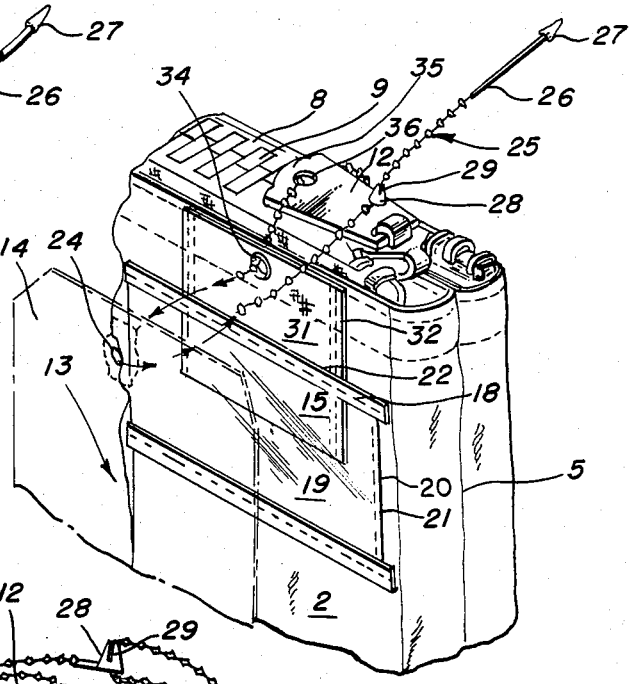
FIG. 3 is a perspective view, similar to FIG. 2, but showing the threading and positioning of the plastic seal relative to the card, eyeletted patches, and slider finger grip.
Figure 4:
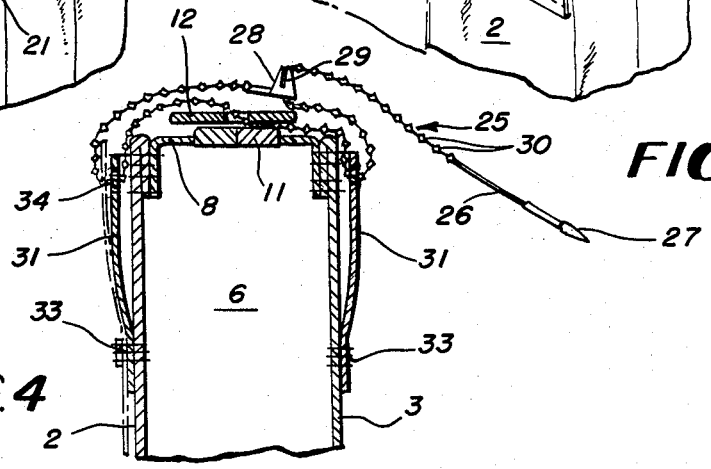
FIG. 4 is a section on the line 4—4 of FIG. 2.

Referring more particularly to the drawings, wherein similar reference characters designate like parts throughout the several views, numeral 1 generally refers to a bag-like container for carrying mail and the like and consisting of two rectangular panels 2 and 3 of some suitable flexible opaque material, such as Nylon or other plastic or woven fabric. These panels are formed from a single sheet of material and are joined together by a fold line along bottom edge 4 and by sewing or stitching 5 along the end edges to form a main pocket 6.

A mouth for the main pocket is formed by the two top edges 7 of the two panels 2–3, and a slide fastener 8 is connected to and extends therealong for selectively opening and closing the mouth. The slide fastener may be of any conventional type usually including a single continuous tooth strip 9 sewn to the panels adjacent top edges, as at 10. A slider 11 having a finger grip 12 pivoted thereto cooperates with the tooth strip to open and close the mouth of the bag as it is drawn back and forth from one end of the bag to the other, in the usual manner.

Arranged adjacent and generally parallel to one end of one of the panels 2–3 is a card pocket 13 for receiving an address and postage card 14. The card pocket may be defined by a generally rectangular upper section 15, spaced below the zippered bag mouth, and a correspondingly shaped bottom section 16, spaced below the upper section to provide an open and uncovered mid section 17 therebetween. Each section 15–16 is bordered with a suitable edge binding 18 extending therearound, or, at least, across the top and bottom edges thereof, and a transparent flexible viewing patch 19 is affixed to the edge bindings so as to be superposed over the respective pocket sections. The vertically extending side edges 20 of sections 15–16 are suitably affixed, by stitching or the like 21, to front panel 2 and with the upper and lower transverse binding edges 22 being unattached to the panel. Thus, the card 14 may be sleeved downwardly through the two spaced sections 15–16 until the lower edge of the card abuts the attached lower binding edge 22 of lower section 16, so that the upper and lowermost portions of the card are covered and protected by the transparent viewing patches 19, and the mid portion 17 of the card is exposed and uncovered. As the addresses of the addressor and addressee are inscribed on the spaced and covered upper and lower portions of the card and are visible therethrough, postage may be readily affixed to the uncovered mid portion 23, and may be cancelled with ease by the postal authorities.

When the card is arranged within pocket 13, the upper end thereof projects upwardly beyond the uppermost transverse edge binding 22 of the upper pocket section 15 so as to be exposed, and is apertured, as at 24. An elongated plastic tie seal 25 embodying a flexible rod 26 having one end pointedly tipped and tapered, as at 27, and the other end formed with a hollow truncated cone 28, which is slotted, as at 29, and with rod 26 between the opposing ends having a plurality of spaced tapered heads or the like 30 integrally formed thereon. Thus, as will hereinafter be apparent, when it is desired to form a tie or seal, the pointed tipped end of the rod is sleeved through the truncated cone 28 and tightened, as desired, so that the beads thereon will be wedged in the cone and prevented from being withdrawn therethrough. Accordingly, when in such a sealing position, removal thereof can be effected by severing the tie seal.

Generally rectangular patches 31, of suitable fabric material, such as the same Nylon material as the bag panels, are suitably affixed along their side and bottom edges 32 by stitching or the like 33 to each of the bag panels so that the patches are oppositely alined just below the slide zipper and generally above the card pocket. The upper edges of the two patches 31 are unattached to the panels and each is formed with an eyeletted aperture 34. With the address card positioned within its mounting pocket, and the mouth end of the bag closed by sliding the zipper to one end, the plastic tie seal 25 may be readily installed by inserting the tipped end 27 thereof through aperture 24 in address card 14 and, thence, through eyeletted aperture 34 in patch 31 on the front bag panel and upwardly and rearwardly across the outer end 35 of the slider finger grip 12 and downwardly through an aperture 36 formed therein. Thereafter, the tipped end 27 is threaded rearwardly through the eyeletted aperture 34 in the patch on the rear bag panel and, thence, upwardly and is inserted through the hollow slotted truncated cone 28 on the other end of the flexible rod 26. By, thereafter, pulling or drawing the tipped end until the rod extends generally flatly across the upper surface of the slider finger grip, it will be evident that the latter is pressed downwardly against the slide fastener and locked in closed position. The only way the seal may be removed is by severing the same. Accordingly, if unauthorized access is gained to the bag and the contents disturbed, the seal will be either removed, or left severed, so that authorized personnel will be aware of previous tampering.

While the preferred embodiment of transit bag with address card pocket and address card, eyeletted patches, and plastic tie seal and apertured slider finger grip has been shown and described, it is to be understood that various changes and improvements may be made therein without departing from the scope and spirit of the appended claims.

What I claim is:

1. A bag for carrying mail or the like comprising two overlying panels of similar size and shape secured along their two peripheral sides and bottom edges to form a main pocket therebetween, said top edges being unsecured to provide a mouth, a slide fastener connected to said panels along said top edges for opening and closing said main pocket mouth, a transparent card pocket, an address card removably inserted within said pocket and being apertured at its upper end, patch means alinedly secured along their side and bottom edges to each of said panels with their upper edges being unsecured and apertured, said patch means generally underlying said card pocket and projecting thereabove and terminating below said slide fastener when in mouth closing position. Finger grip means hinged to said slide fastener and formed with an aperture in one end, and plastic tie seal means including a flexible rod tipped at one end and formed with a hollow truncated cone at its other end and having a plurality of spaced bead means therebetween, whereby when said seal means is inserted through said card, patch and finger grip apertures and said tipped end is threaded through said cone the seal means may be tightened relative to and for retaining said slide fastener in closed locked position and preventing the disengagement of said address card and whereby unauthorized entry into said bag necessitates severing said tie seal means thereby leaving overt evidence thereof.

2. A bag according to claim 1, wherein said card pocket includes spaced upper and lower sections covered with transparent material and an exposed mid portion therebetween, and said patch means are generally rectangular.

3. A bag according to claim 1, wherein the hollow truncated cone on said plastic tie seal rod is slotted and said spaced bead means are integrally formed on said rod and bindingly engage with said cone to lock said finger grip means in closed position relative to said slide fastener.

4. A bag according to claim 2, wherein an exposed open blank mid portion is interposed between said upper and lower card pocket sections whereby addresses on said card may be covered and the exposed blank mid portion is accessible for receiving and cancelling postage.

* * * * *